US009011122B2

(12) United States Patent
Hayashimoto et al.

(10) Patent No.: US 9,011,122 B2
(45) Date of Patent: Apr. 21, 2015

(54) STATOR SEAL STRUCTURE IN UNIAXIAL SCREW PUMP

(75) Inventors: Kazutomo Hayashimoto, Oyama (JP); Jun Taneichi, Oyama (JP)

(73) Assignee: Furukawa Industrial Machinery Systems Co., Ltd., Chiyoda-Ku, Tokyo (JP)

( * ) Notice: Subject to any disclaimer, the term of this patent is extended or adjusted under 35 U.S.C. 154(b) by 152 days.

(21) Appl. No.: 13/811,328

(22) PCT Filed: Aug. 11, 2011

(86) PCT No.: PCT/JP2011/004564

§ 371 (c)(1), (2), (4) Date: Jan. 21, 2013

(87) PCT Pub. No.: WO2012/026085

PCT Pub. Date: Mar. 1, 2012

(65) Prior Publication Data

US 2013/0115058 A1 May 9, 2013

(30) Foreign Application Priority Data

Aug. 25, 2010 (JP) ..... 2010-188736

(51) Int. Cl.
*F04C 2/00* (2006.01)
*F01D 25/00* (2006.01)
(Continued)

(52) U.S. Cl.
CPC ..... *F01D 25/00* (2013.01); *F04C 2/1071* (2013.01); *F04C 15/0034* (2013.01); *F04C 2/1075* (2013.01)

(58) Field of Classification Search
CPC .... F04C 2/1071; F04C 2/1073; F04C 2/1075; F04C 27/008; F04C 27/001; F04C 27/00; F04C 15/003; F01C 1/101; F01C 1/104
USPC ..... 418/48, 166, 104, 112, 125–129; 277/358, 370
See application file for complete search history.

(56) References Cited

U.S. PATENT DOCUMENTS 2,296,724 A * 9/1942 McCormack ..... 29/890.035
2,505,136 A * 4/1950 Moineau ..... 418/5
(Continued)

FOREIGN PATENT DOCUMENTS

JP 59-153992 A 9/1984
JP 01313685 A * 12/1989 ..... F04C 18/16
JP 2008-175199 A 7/2008

OTHER PUBLICATIONS

Translation of International Preliminary Report on Patentability (Chapter I or Chapter II) in International Application No. PCT/JP2011/004564, mailed Mar. 28, 2013.

*Primary Examiner* — Thomas Denion
*Assistant Examiner* — Jason T Newton
(74) *Attorney, Agent, or Firm* — Young Basile Hanlon & MacFarlane P.C.

(57) ABSTRACT

There is provided a stator seal structure in a uniaxial eccentric screw pump by which the abrasion resistance of sealing mechanisms is improved and the pumped fluid can be prevented from stagnating in the sealing mechanisms. The stator seal structure is provided with a pair of sealing mechanisms for sealing between a housing and an intake side end portion, and between the housing and a discharge side end portion of the stator. The pair of sealing mechanisms is provided with ring-shaped secured rings respectively secured to the housing. The secured rings are respectively attached with elastic bodies for ensuring contact pressures between the sliding seal surface of the stator and the sliding seal surface of the secured rings with the elastic forces of the elastic bodies and for sealing between the secured rings and the housing.

5 Claims, 6 Drawing Sheets

(51) Int. Cl.
*F04C 2/107* (2006.01)
*F04C 15/00* (2006.01)

(56) References Cited

U.S. PATENT DOCUMENTS 4,558,872 A * 12/1985 Vossieck et al. ..... 277/379
4,907,906 A * 3/1990 Hantschk ..... 403/154
5,332,235 A * 7/1994 Fone et al. ..... 277/380
5,407,337 A * 4/1995 Appleby ..... 418/166
6,616,144 B2 * 9/2003 Theodore, Jr. ..... 277/358
7,293,778 B1 * 11/2007 Rode ..... 277/370
7,651,099 B1 * 1/2010 Rode ..... 277/306
2010/0092317 A1 4/2010 Suhara et al.

* cited by examiner

STATOR SEAL STRUCTURE IN UNIAXIAL SCREW PUMP

TECHNICAL FIELD

The present invention relates to a stator seal structure in a uniaxial eccentric screw pump for pumping a fixed quantity of viscous liquid such as a food raw material, chemical raw material, sewage sludge, and the like.

BACKGROUND

As a conventional uniaxial eccentric screw pump of this type, the uniaxial eccentric screw pump described in JP Publication No. 59-153992 is known. That uniaxial eccentric screw pump is provided with a male-threaded rotor directly coupled to a driving shaft and a stator rotatably supported by a housing via bearings. A female-threaded inner surface has its rotational axial line eccentrically arranged with respect to a rotational axial line of the rotor. The rotor pumps the fluid from the intake side to the discharge side, while rotating and by eccentrically moving with respect to the rotational axial line of the stator.

Specifically, in the uniaxial eccentric screw pump described in JP Publication No. 59-153992, in which the stator is rotatably supported by the housing via the bearings, in order to prevent the fluid taken in on the intake side from entering between the housing and the stator and to prevent the fluid from entering between the housing and the stator from the discharge side, a seal member is provided between the secured housing, and an intake side end portion of the rotating stator and a discharge side end portion thereof to seal between the housing and the stator.

FIG. 6 shows an example of a uniaxial eccentric screw pump of this type, in which seal member is arranged between the housing and the intake side end portion of the stator and between the housing and the discharge side end portion of the stator.

A uniaxial eccentric screw pump 101 shown in FIG. 6 has a frame 111 for accommodating a driving shaft 102 coupled to a motor (not shown). The driving shaft 102 is rotatably supported by the frame 111 via bearings 116.

The frame 111 is attached to a housing 110. The housing 110 is provided with, sequentially from the intake side (from the right side of FIG. 6): an intake portion 110*a*; a main portion 110*b*; and a discharge portion 110*c*. The intake portion 110*a* of the housing 110 is formed with an inlet 112 for the fluid to be pumped, and the discharge portion 110*c* is formed with an outlet 113 for the pumped fluid.

Then, the uniaxial eccentric screw pump 101 is provided in the housing 110 with a male-threaded rotor 103 and a stator 104 having a female-threaded inner surface.

The rotor 103 is constituted by a helical portion 103*a* on the front end side and a base end portion 103*b* on the back end side. The base end portion 103*b* linearly extends in the frame 111 and is coupled to the driving shaft 102 without a use of a universal joint. The base end portion 103*b* of the rotor 103 is coupled to the driving shaft 102, and rotates together with the driving shaft 102. On the other hand, the helical portion 103*a* has an elliptical cross-section eccentric with respect to the rotational axial line of itself, and the helical portion 3*a* is internally provided in the stator 104 having a female-threaded inner surface.

The rotational axis of the rotor 103 is arranged to be eccentric by a predefined eccentric amount with respect to the rotational axial line of the stator 104.

Both ends of the stator 104 are rotatably supported by the housing 110 via a pair of bearings 105 and 106. The bearing 105 of the pair of bearings 105 and 106 is a self-lubricating bearing, and is arranged on the discharge side of the stator 104. On the other hand, the bearing 106 is a self-lubricating bearing, and is arranged on the intake side of the stator 104. The bearing 105 is directly attached to the main portion 110*b* of the housing 110, whereas the bearing 106 is attached to the intake portion 110*a* and the main portion 110*b* of the housing 110 via a bearing housing 107. The rotation of the bearing housing 107 is stopped by a key member 108.

In addition, the stator 104 is constituted by a metallic outer stator cylinder 104*a* and a rubber inner stator cylinder 104*b* arranged in the metallic outer stator cylinder 104*a*. The rubber inner stator cylinder 104*b* is formed with a helical female screw hole having an elliptical cross-sectional shape with a double pitch of the helical portion 103*a* of the rotor 103.

As a stator seal structure, in order to prevent the fluid taken in from the inlet 112 from entering between the housing 110 and the stator 104, a lip seal 114 is provided between the housing 110 and the intake side end portion of the stator 104. In order to prevent the fluid from entering between the housing 110 and the stator 104 from the outlet 113, a lip seal 115 is provided between the housing 110 and the discharge side end portion of the stator 104. The lip seals 114 and 115 are made from Teflon® or rubber for sealing spaces between the housing 110 and the stator 104.

Specifically, a mechanical seal 120 is provided between the base end portion 103*b* of the rotor 103 and is coupled to the driving shaft 102 and the frame 111. The mechanical seal 120 has a function of blocking the pumped fluid flown in from the inlet 112 from flowing into the frame 111 through a gap between the base end portion 103*b* and the frame 111.

The mechanical seal 120 is provided with: a rotating ring 121 arranged around the base end portion 103*b* and a secured ring 122 arranged to be opposite to the rotating ring 121 in a rotational axial line direction of the base end portion 103*b* and secured to the frame 111. A flange member 124 is secured by a securing pin 125 around the base end portion 103*b* on the helical portion 103*a* side rather than the rotating ring 121 side. A spring 123, for biasing the rotating ring 121 in a direction toward the secured ring 122 and pressing the rotating ring 121 against the secured ring 122, is arranged between the flange member 124 and the rotating ring 121. This causes a sliding seal surface of the rotating ring 121 and a sliding seal surface of the secured ring 122 to contact with each other slidably in a circumferential direction, thereby ensuring a predefined contact pressure to seal space between the rotating ring 121 and the secured ring 122.

SUMMARY

In the stator seal structure of the uniaxial eccentric screw pump 101 shown in FIG. 6, however, there are following problems.

That is, in a case where the pumped fluid is liquid with a high abrasive property, there is a problem in that the lip seals 114 and 115 made from Teflon® or rubber wear out in a short term. This is because the lip seals 114 and 115, which are made from Teflon® or rubber inferior in abrasion resistance, are used for sealing space between the housing 110 that is secured and the stator 104 that is a rotating body.

Besides, there is another problem in that the lip seals 114 and 115 each have a depressed area and the pumped fluid sometimes stagnates therein. This makes complete cleaning difficult.

Accordingly, the present invention has been made to solve the above problems, and has an object to provide a stator seal structure in a uniaxial eccentric screw pump in order to improve the abrasion resistance of a sealing mechanism between a housing and an intake side end portion of a stator and between the housing and a discharge side end portion of the stator, and to prevent the pumped fluid from stagnating in the sealing mechanism.

In order to solve the above problems, according to a first aspect of the present invention, there is provided a stator seal structure in a uniaxial eccentric screw pump, the stator seal structure comprising: a male-threaded rotor coupled to a driving shaft; a stator rotatably coupled to a housing via a bearing and having a female-threaded inner surface with a rotational axial line arranged to be eccentric with respect to a rotational axial line of the rotor; and a pair of sealing mechanisms for sealing space between the housing and an intake side end portion of the stator and space between the housing and a discharge side end portion of the stator. Each of the pair of sealing mechanisms has a sliding seal surface arranged to be opposite to a sliding surface of the stator in a direction of the rotational axial line of the rotor and has a ring-shaped secured ring secured to the housing, wherein the secured ring is attached with an elastic body for ensuring, with an elastic force of the elastic body, a contact pressure between the sliding seal surface of the stator and the sliding seal surface of the secured ring and for sealing space between the secured ring and the housing. The secured ring is made of ceramics or cemented carbide, and the sliding seal surface of the stator is coated with ceramics.

According to the stator seal structure in the uniaxial eccentric screw pump according to the first aspect of the present invention, each of the pair of sealing mechanisms has a sliding seal surface arranged to be opposite to a sliding surface of the stator in a direction of the rotational axial line of the rotor, and has a ring-shaped secured ring secured to the housing. The secured ring is attached with an elastic body for ensuring, with an elastic force of the elastic body, a contact pressure between the sliding seal surface of the stator and the sliding seal surface of the secured ring and for sealing space between the secured ring and the housing. It is therefore possible to seal space between the housing and the intake side end portion and space between the housing and the discharge side end portion with certainty. In addition, the secured ring is made of ceramics or cemented carbide, and the sliding seal surface of the stator is coated with ceramics, so that a sealing portion can be constituted by the sliding members that are superior in abrasion resistance. It is therefore possible to improve the abrasion resistance of the pair of the sealing mechanisms between the housing and the intake side end portion and between the housing and the discharge side end portion. Thus, even if the pumped fluid has high abrasiveness, the problem of abrasion occurring in a short term can be avoided and the stable sealing property in a long term can be ensured. Furthermore, since the sealing portion is constituted by the sliding seal surface of the secured ring and the sliding seal surface of the stator constituting a rotating body, it is possible to solve the problem that the pumped fluid stagnates in the depressed area as in the case of the lip seal.

According to a second aspect of the present invention, there is provided a stator seal structure in a uniaxial eccentric screw pump, the stator seal structure comprising: a male-threaded rotor coupled to a driving shaft; a stator rotatably coupled to a housing via a bearing and having a female-threaded inner surface with a rotational axial line arranged to be eccentric with respect to a rotational axial line of the rotor; and a pair of sealing mechanisms for sealing space between the housing and an intake side end portion of the stator and space between the housing and a discharge side end portion of the stator. Each of the pair of sealing mechanisms has a ring-shaped rotating ring attached to the stator, and a secured ring arranged to be opposite to the rotating ring in a direction of the rotational axial line of the rotor and having a sliding seal surface sliding on a sliding seal surface of the rotating ring and secured to the housing. The secured ring is attached with an elastic body for ensuring with an elastic force of the elastic body a contact pressure between the sliding seal surface of the rotating ring and the sliding seal surface of the secured ring and for sealing space between the secured ring and the housing, wherein the rotating ring is made of ceramics or cemented carbide, and wherein the secured ring is made of ceramics or cemented carbide.

According to the stator seal structure in the uniaxial eccentric screw pump according to the second aspect of the present invention, each of the pair of sealing mechanisms has a ring-shaped rotating ring attached to the stator, and a secured ring arranged to be opposite to the rotating ring in a direction of the rotational axial line of the rotor and having a sliding seal surface sliding on a sliding seal surface of the rotating ring and secured to the housing. The secured ring is attached with an elastic body for ensuring with an elastic force of the elastic body a contact pressure between the sliding seal surface of the rotating ring and the sliding seal surface of the secured ring and for sealing space between the secured ring and the housing.

It is therefore possible to seal space between the housing and the intake side end portion, and between the housing and the discharge side end portion, with certainty. In addition, the rotating ring is made of ceramics or cemented carbide, and the secured ring is made of ceramics or cemented carbide, so that the sliding members are constituted by the sealing portion that is superior in abrasion resistance, as in the same manner with the stator seal structure according to the first aspect of the present invention. It is therefore possible to improve the abrasion resistance of the pair of the sealing mechanisms between the housing and the intake side end portion and between the housing and the discharge side end portion. Thus, even if the pumped fluid has high abrasiveness, the problem of abrasion occurring in a short term can be avoided and a stable sealing property in a long term can be ensured.

Furthermore, since the sealing portion is constituted by the secured ring and the rotating ring attached to the stator constituting a rotating body, it is possible to solve the problem that the pumped fluid stagnates in the depressed area as in the case of a lip seal.

Moreover, in the stator seal structure in the uniaxial eccentric screw pump according to the second aspect of the present invention, the rotating ring may be shrinkage fit to the stator.

Additionally, in the stator seal structure in the uniaxial eccentric screw pump according to the second aspect of the present invention, the rotating ring may be secured to the stator by a baffle pin.

Further, in the stator seal structure in the uniaxial eccentric screw pump according to the first aspect of the present invention, inner diameters of the discharge side end portion of the stator, the secured ring of the sealing mechanism, which is one of the pair of the sealing mechanisms for sealing space between the housing and a discharge side end portion of the stator, the elastic body attached to the rotating ring, and a discharge portion of the housing have the same size. A pressure-receiving surface may have a cylindrical shape.

According to the stator seal structure in the uniaxial eccentric screw pump in this aspect, the inner diameters of the secured ring of the sealing mechanism, which is one of the pair of the sealing mechanisms for sealing space between the housing and a discharge side end portion of the stator, the elastic body attached to the rotating ring, and a discharge portion of the housing have the same size, and a receiving surface may have a cylindrical shape. Accordingly, the pressure of the fluid applied from the discharge portion side of the housing is prevented from being applied onto the secured ring as a thrust load. This eliminates a dead space at the discharge portion and creates a smooth flow of the fluid.

As described above, according to a stator seal structure in a uniaxial eccentric screw pump according to the present invention, it is possible to improve the abrasion resistance of a pair of sealing mechanisms between a housing and an intake side end portion of a stator and between the housing and a discharge side end portion of the stator, and to prevent the pumped fluid from stagnating in the sealing mechanism.

BRIEF DESCRIPTION OF THE DRAWINGS

The description herein makes reference to the accompanying drawings wherein like reference numerals refer to like parts throughout the several views, and wherein.

DETAILED DESCRIPTION OF EMBODIMENTS

Figure 1:
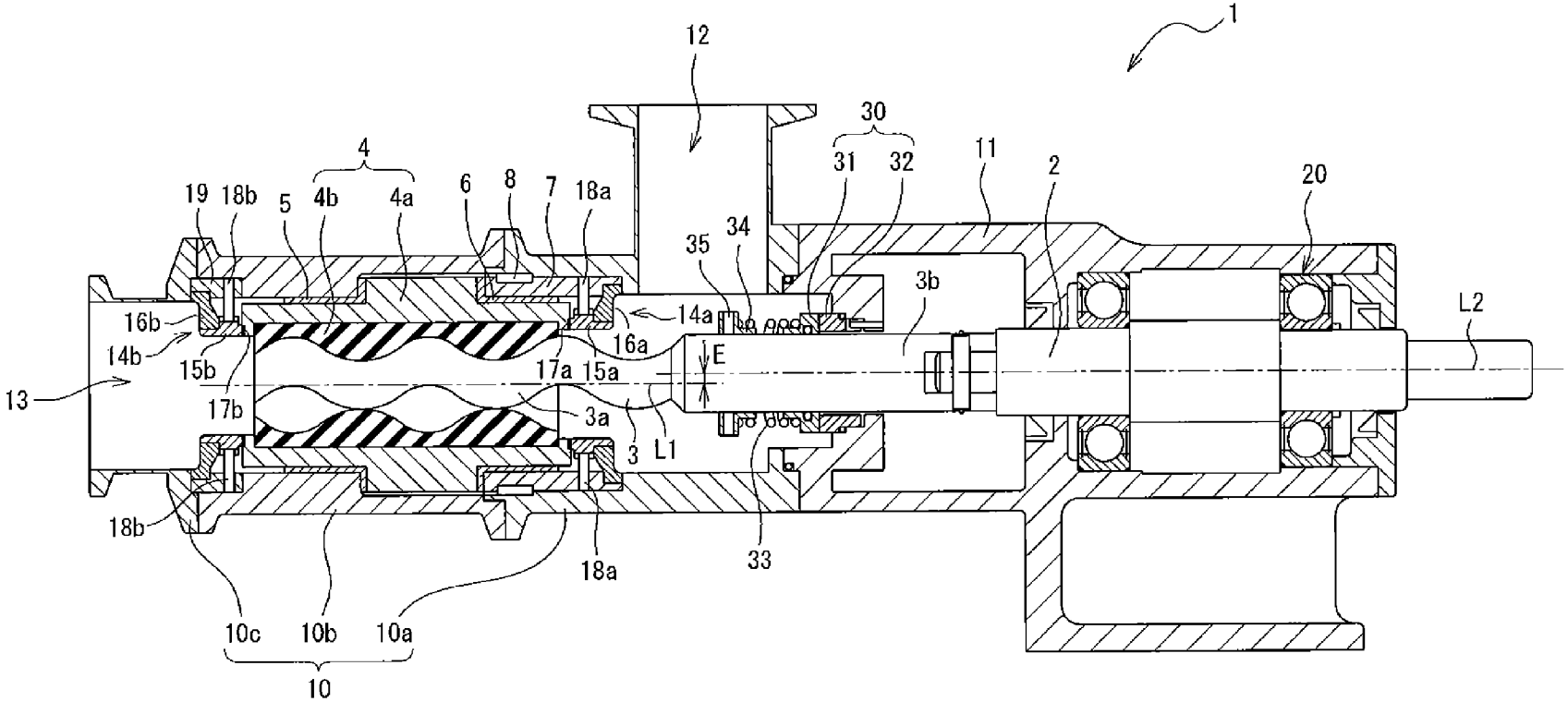
FIG. 1 is a side view of a stator seal structure in a uniaxial eccentric screw pump according to a first embodiment of the present invention, and illustrates substantial parts in a cross section taken along an axial line.

Hereinafter, embodiments of the present invention will be described with reference to the drawings as needed. FIG. 1 is a side view of a stator seal structure in a uniaxial eccentric screw pump according to a first embodiment of the present invention. In FIG. 1, substantial parts are illustrated in a cross section taken along an axial line.

A uniaxial eccentric screw pump 1 illustrated in FIG. 1 has a frame 11 for accommodating a driving shaft 2 coupled to a motor (not illustrated). The driving shaft 2 is rotatably supported by the frame 11 via bearings 20. The frame 11 is attached to a housing 10. The housing 10 is provided with, sequentially from the intake side (from the right side of FIG. 1): an intake portion 10*a*; a main portion 10*b*; and a discharge portion 10*c*. The intake portion 10*a* of the housing 10 is formed with an inlet 12 for the pumped fluid, and the discharge portion 10*c* is formed with an outlet 13 for the pumped fluid.

Then, the uniaxial eccentric screw pump 1 is provided in the housing 10 with a male-threaded rotor 3 and a stator 4 having a female-threaded inner surface.

The rotor 3 is constituted by a helical portion 3*a* on the front end side and a base end portion 3*b* on the back end side. The base end portion 3*b* linearly extends in the frame 11 and is coupled to the driving shaft 2 without a use of a universal joint. The base end portion 3*b* of the rotor 3 is coupled to the driving shaft 2, and rotates together with the driving shaft 2. On the other hand, the helical portion 3*a* has an elliptical cross-section eccentric with respect to the rotational axial line L2 thereof, and the helical portion 3*a* is internally provided in the stator 4 having a female-threaded inner surface. The rotational axial line L2 of the rotor 2 is arranged to be eccentric by a predefined eccentric amount E with respect to the rotational axial line L1 of the stator 4.

Both ends of the stator 4 are supported rotatably with respect to the housing 10 via a pair of bearings 5 and 6. The bearing 5 of the pair of bearings 5 and 6 is arranged on the discharge side of the stator 4, whereas the bearing 6 is arranged on the intake side. The bearing 5 is a self-lubricating bearing, and is directly attached to the main portion 10*b* of the housing 10. On the other hand, the bearing 6 is a self-lubricating bearing, and is attached to the intake portion 10*a* and the main portion 10*b* of the housing 10 via a bearing housing 7. The rotation of the bearing housing 7 is stopped by a key member 8.

In addition, the stator 4 is constituted by an outer stator cylinder 4*a* made of metal and an inner stator cylinder 4*b* made of rubber arranged in the outer stator cylinder 4*a*. The inner stator cylinder 4*b* is formed with a helical female screw hole having an elliptical cross-sectional shape with a double pitch of the helical portion 3*a* of the rotor 3.

As a stator seal structure, in order to prevent the fluid taken in from the inlet 12 from entering between the housing 10 and the stator 4, a sealing mechanism 14*a* is provided between the housing 10 and the intake side end portion of the stator 4. In the meanwhile, in order to prevent the fluid from entering between the housing 10 and the stator 4 from the outlet 13, a sealing mechanism 14*b* is provided between the housing 10 and the discharge side end portion of the stator 4.

In such a situation, a sealing mechanism 14*a* seals between the housing 10 and the intake side end portion of the stator 4, and the sealing mechanism 14*a* is provided with a secured ring 15*a*. The secured ring 15*a* is a ring-shaped member having an inner diameter same with that of the intake side end portion of the outer stator cylinder 4*a* of the stator 4. The secured ring 15*a* is arranged to be opposite to the outer stator cylinder 4*a* in a direction of the rotational axial line L2 of the rotor 3, and has a sliding seal surface that slides on a sliding seal surface of the stator 4 (that is, the outer stator cylinder 4*a*). The secured ring 15*a* is secured to the bearing housing 7 by a pair of baffle pins 18*a* so that the bearing housing 7 is secured to the intake portion 10*a* and the main portion 10*b* of the housing 10. This results in that the secured ring 15*a* is also secured to the housing 10. Then, the secured ring 15*a* is attached with an elastic body 16*a* for ensuring with an elastic force thereof the contact pressure between the sliding seal surface of the stator 4 (that is, the outer stator cylinder 4*a*) and the sliding seal surface of the secured ring 15*a*, and for sealing space between the secured ring 15*a* and the housing 10 (that is, the intake portion 10*a*). The secured ring 15*a* is produced with ceramics or cemented carbide. In addition, the sliding seal surface of the stator 4 (that is, the outer stator cylinder 4*a*) is provided with a ceramics coating 17*a*.

On the other hand, the sealing mechanism 14*b* arranged between the housing 10 and the discharge side of the stator 4 seals between the housing 10 and the discharge side end portion of the stator 4. The sealing mechanism 14*b* is provided with a secured ring 15*b*. The secured ring 15*b* is a ring-shaped member having an inner diameter same as that of the discharge side end portion of outer stator cylinder 4*a* of the stator 4. The secured ring 15*b* is arranged to be opposite to the outer stator cylinder 4*a* in the direction of the rotational axial line L2 of the rotor 3, and has a sliding seal surface that slides on a sliding seal surface of the stator 4 (that is, the outer stator cylinder 4*a*). The secured ring 15*b* is secured to a seal case 19 by a pair of baffle pins 18*b*. The seal case 19 is secured to the discharge portion 10*c* and the main portion 10*b* of the housing 10. This results in that the secured ring 15*b* is also secured to the housing 10. Then, the secured ring 15*b* is attached with an elastic body 16*b* for ensuring, with an elastic force thereof, the contact pressure between the sliding seal surface of the stator 4 (that is, the outer stator cylinder 4*a*) and the sliding seal surface of the secured ring 15*b*, and for sealing space between the secured ring 15*b* and the housing 10 (that is, the discharge portion 10*c*). The secured ring 15*b* is produced with ceramics or cemented carbide. In addition, the sliding seal surface of the stator 4 (that is, the outer stator cylinder 4*a*) is provided with a ceramics coating 17*b*.

A mechanical seal 30 is provided between the base end portion 3*b* of the rotor 3 and is coupled to the driving shaft 2 and the frame 11. The mechanical seal 30 has a function of blocking the pumped fluid flown in from the inlet 12 from flowing into the frame 11 through a gap between the base end portion 3*b* and the frame 11.

The mechanical seal 30 is provided with a rotating ring 31 arranged around the base end portion 3*b* and a secured ring 32 arranged to be opposite to the rotating ring 31 in the direction of the rotational axial line of the base end portion 3*b* and secured to the frame 11. A flange member 34 is secured by a securing pin 35 around the helical portion 3*a* side opposite to the rotating ring 31 side in the base end portion 3*b*. A spring 33, for biasing the rotating ring 31 in a direction toward the secured ring 32 and pressing the rotating ring 31 against the secured ring 32, is arranged between the flange member 34 and the rotating ring 31. This causes a sliding seal surface of the rotating ring 13 and a sliding seal surface of the secured ring 32 to contact with each other slidably in a circumferential direction, thereby ensuring a predefined contact pressure to seal space between the rotating ring 31 and the secured ring 32.

In the uniaxial eccentric screw pump 1 with such a configuration, when the driving shaft 2 rotates, the rotor 3 rotates around the rotational axial line L2 including the base end portion 3*b*. A helical portion 3*a* of the rotor 3 eccentrically moves with respect to the rotational axial line L2. Then, in accordance with the movement of the helical portion 3*a* of the rotor 3, the stator 4 is driven to rotate in synchronization with the rotation of the rotor 3 around the rotational axial line L1, and the pumped fluid is pumped to the outlet 13 from the inlet 12.

In this situation, the sealing mechanism 14*a* prevents the pumped fluid pumped to the outlet 13 from the inlet 12 from entering between the stator 4 (that is, the outer stator cylinder 4*a*) and the housing 10 (that is, the intake portion 10*a*) with certainty. This is because the sealing mechanism 14*a* is arranged to be opposite to the stator 4 (that is, the outer stator cylinder 4*a*) in the direction of the rotational axial line L2 of the rotor 3, and the sealing mechanism 14*a* has a sliding seal surface for sliding on the sliding seal surface of the stator 4. In addition, the sealing mechanism 14*a* is provided with the ring-shaped secured ring 15*a* secured to the housing 10. The secured ring 15*a* is attached with the elastic body 16*a* for ensuring, with the elastic force thereof, the contact pressure between the sliding seal surface of the stator 4 and the sliding seal surface of the secured ring 15*a*, and for sealing space between the secured ring 15*a* and the housing 10.

Furthermore, the secured ring 15*a* is made of ceramics or cemented carbide and the ceramics coating 17*a* is provided on the sliding seal surface of the stator 4. Therefore, a sealing portion is constituted by sliding members superior in abrasion resistance. It is possible to improve the abrasion resistance of the sealing mechanism 14*a* between the housing 10 and the intake side end portion of the stator 4. Hence, even if the pumped fluid has high abrasiveness, the problem of abrasion occurring in a short term can be avoided and a stable sealing property in a long term can be ensured.

On the other hand, the sealing mechanism 14*b* prevents the fluid from the outlet 13 from entering between the stator 4 (that is, the outer stator cylinder 4*a*) and the housing 10 (that is, the discharge portion 10*c*) with certainty. This is because the sealing mechanism 14*b* is arranged to be opposite to the stator 4 (that is, the outer stator cylinder 4*a*) in the direction of the rotational axial line L2 of the rotor 3, and the sealing mechanism 14*b* has a sliding seal surface for sliding on the sliding seal surface of the stator 4. In addition, the sealing mechanism 14*b* is provided with the ring-shaped secured ring 15*b* secured to the housing 10. The secured ring 15*b* is attached with the elastic body 16*b* for ensuring, with the elastic force thereof, the contact pressure between the sliding seal surface of the stator 4 and the sliding seal surface of the secured ring 15*b*, and for sealing space between the secured ring 15*b* and the housing 10.

Furthermore, the secured ring 15*b* is made of ceramics or cemented carbide and the ceramics coating 17*b* is provided on the sliding seal surface of the stator 4. Therefore, the sealing portion is constituted by sliding members superior in abrasion resistance. It is possible to improve the abrasion resistance of the sealing mechanism 14*b* between the housing 10 and the intake side end portion of the stator 4. Hence, even if the pumped fluid has high abrasiveness, the problem of abrasion occurring in a short term can be avoided and a stable sealing property in a long term can be ensured.

Moreover, since the sealing portion is constituted by the sliding seal surfaces of the secured rings 15*a* and 15*b* and the sliding seal surface of the stator 4 constituting a rotating body, it is possible to solve the problem that the pumped fluid stagnates in the depressed area as in the case of a lip seal.

Figure 2:
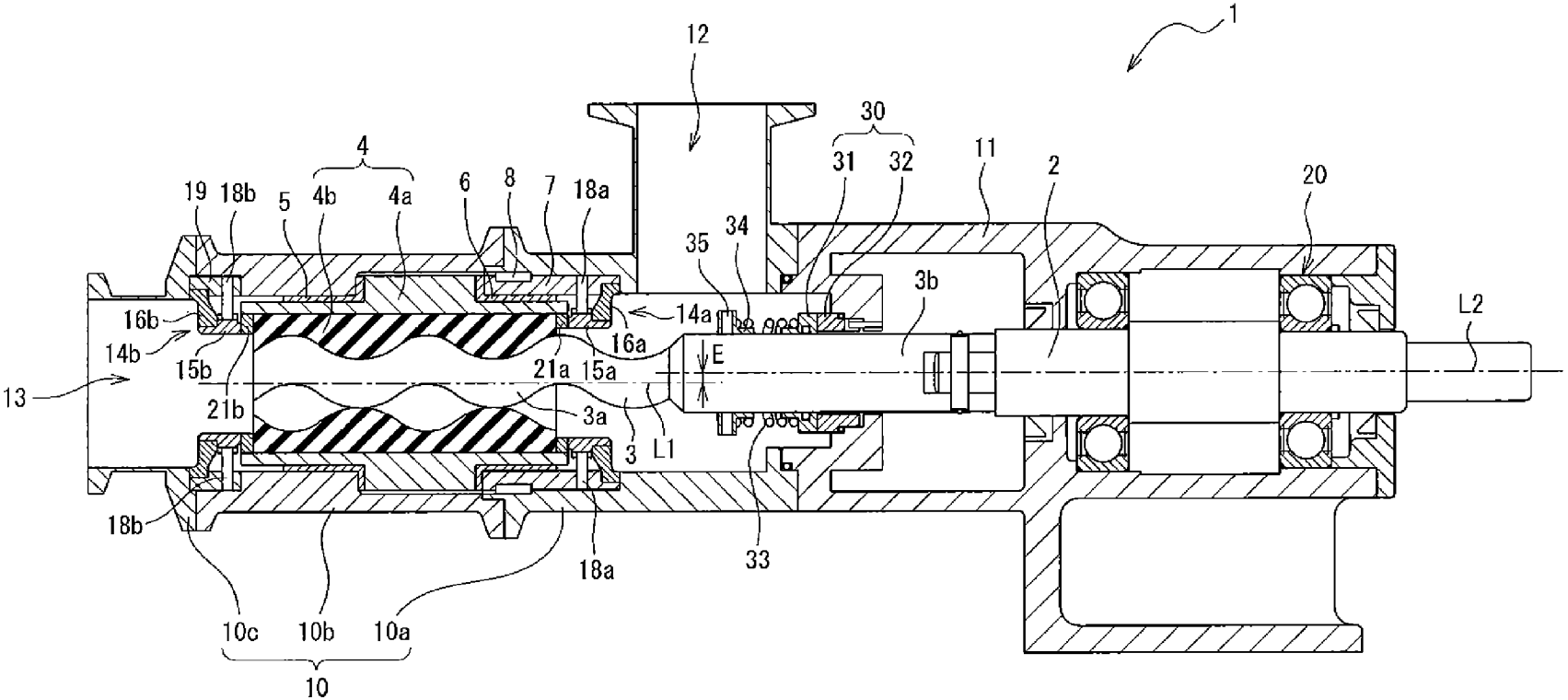
FIG. 2 is a side view of a stator seal structure in a uniaxial eccentric screw pump according to a second embodiment of the present invention, and illustrates substantial parts in a cross section taken along the axial line.

Next, a stator seal structure in a uniaxial eccentric screw pump according to a second embodiment of the present invention will be described with reference to FIG. 2. FIG. 2 is a side view of a stator seal structure in a uniaxial eccentric screw pump according to the second embodiment of the present invention. In FIG. 2, the substantial parts are illustrated in a cross section taken along the axial line. In FIG. 2, the same components and configurations as those employed in the first embodiment have the same reference numerals and detailed explanations thereof will be omitted.

The uniaxial eccentric screw pump 1 illustrated in FIG. 2 has almost the same configurations with those illustrated in FIG. 1. The configurations of the sealing mechanisms 14*a* and 14*b*, however, are different.

That is, the sealing mechanism 14*a* in the uniaxial eccentric screw pump 1 illustrated in FIG. 2 is provided for sealing space between the housing 10 and the intake side end portion of the stator 4 in the same manner as the sealing mechanism

14*a* illustrated in FIG. 1, but is different in that a rotating ring 21*a* is provided. The rotating ring 21*a* is constituted by a ring-shaped member and is attached to an inner circumferential surface of the intake side end portion of the outer stator cylinder 4*a* in the stator 4 by shrinkage fitting. The rotating ring 21*a* is made of ceramics or cemented carbide. In addition, the sealing mechanism 14*a* is provided with a secured ring 15*a* in the same manner as the sealing mechanism 14*a* illustrated in FIG. 1. The secured ring 15*a* is a ring-shaped member having an inner diameter identical to that of the rotating ring 21*a*. The secured ring 15*a* is arranged to be opposite to the rotating ring 21*a* in the direction of the rotational axial line L2 of the rotor 3, and has a sliding seal surface that slides on a sliding seal surface of the rotating ring 21*a*. The secured ring 15*a* is secured to the bearing housing 7 by the pair of baffle pins 18*a* in the same manner as the secured ring 15*a* illustrated in FIG. 1, so that the bearing housing 7 is secured to the intake portion 10*a* and the main portion 10*b* of the housing 10. This results in that the secured ring 15*a* is also secured to the housing 10. Then, the secured ring 15*a* is attached with the elastic body 16*a* for ensuring, with an elastic force thereof, the contact pressure between the sliding seal surface of the rotating ring 21*a* and the sliding seal surface of the secured ring 15*a*, and for sealing space between the secured ring 15*a* and the housing 10 (that is, the intake portion 10*a*). The secured ring 15*a* is produced with ceramics or cemented carbide in the same manner as the secured ring 15*a* illustrated in FIG. 1.

On the other hand, the sealing mechanism 14*b* in the uniaxial eccentric screw pump 1 illustrated in FIG. 2 is provided for sealing space between the housing 10 and the discharge side end portion of the stator 4 in the same manner as the sealing mechanism 14*b* illustrated in FIG. 1, but is different in that a rotating ring 21*b* is provided. The rotating ring 21*b* is constituted by a ring-shaped member and is attached to an inner circumferential surface of the intake side end portion of the outer stator cylinder 4*a* in the stator 4 by shrinkage fitting. The rotating ring 21*b* is made of ceramics or cemented carbide. In addition, the sealing mechanism 14*b* is provided with a secured ring 15*b* in the same manner as the sealing mechanism 14*b* illustrated in FIG. 1. The secured ring 15*b* is a ring-shaped member having an inner diameter identical to that of the rotating ring 21*b*. The secured ring 15*b* is arranged to be opposite to the rotating ring 21*b* in the direction of the rotational axial line L2 of the rotor 3, and has a sliding seal surface that slides on a sliding seal surface of the rotating ring 21*b*. The secured ring 15*b* is secured to the bearing housing 7 by the pair of baffle pins 18*b* in the same manner as the secured ring 15*b* illustrated in FIG. 1, so that the bearing housing 7 is secured to the intake portion 10*a* and the main portion 10*b* of the housing 10. This results in that the secured ring 15*b* is also secured to the housing 10. Then, the secured ring 15*b* is attached with the elastic body 16*b* for ensuring, with an elastic force thereof, the contact pressure between the sliding seal surface of the rotating ring 21*b* and the sliding seal surface of the secured ring 15*b*, and for sealing space between the secured ring 15*b* and the housing 10 (that is, the main portion 10*b*). The secured ring 15*b* is produced with ceramics or cemented carbide in the same manner as the secured ring 15*b* illustrated in FIG. 1.

According to the stator seal structure in the uniaxial eccentric screw pump 1 illustrated in FIG. 2, the pair of sealing mechanisms 14*a* and 14*b* are respectively provided with: the ring-shaped rotating rings 21*a* and 21*b* attached to the stator 4; the sliding seal surfaces that are arranged to be opposite to the rotating rings 21*a* and 21*b*, respectively, in the direction of the rotational axial line L2 of the rotor 3, and that slide on the sliding seal surfaces of the rotating rings 21*a* and 21*b*; and the secured rings 15*a* and 15*b* secured to the housing 10. The secured rings 15*a* and 15*b* are attached with the elastic bodies 16*a* and 16*b*, respectively for ensuring, with the elastic forces thereof, the contact pressure between the sliding seal surfaces of the rotating rings 21*a* and 21*b* and the sliding seal surfaces of the secured rings 15*a* and 15*b*, and for sealing space between the secured rings 15*a* and 15*b* and the housing 10. Therefore, it is possible to seal the housing 10 and the intake side end portion and the discharge side end portion of the stator 4 with certainty.

Then, since the rotating rings 21*a* and 21*b* are made of ceramics or cemented carbide and the secured rings 15*a* and 15*b* are made of ceramics or cemented carbide, the sealing portion is constituted by sliding members superior in the abrasion resistance in the same manner as the sealing mechanisms 14*a* and 14*b* illustrated in FIG. 1. It is therefore possible to improve the abrasion resistance of the pair of the sealing mechanisms 14*a* and 14*b* between the housing 10 and the intake side end portion of the stator 4, and between the housing 10 and the discharge side end portion of the stator 4. Hence, even if the pumped fluid has high abrasiveness, the problem of abrasion occurring in a short term can be avoided and a stable sealing property in the long term can be ensured.

Moreover, since the sealing portion is constituted by the secured rings 15*a* and 15*b* and the rotating rings 21*a* and 21*b* attached to the stator 4 constituting the rotating body, it is possible to solve the problem that the pumped fluid stagnates in the depressed area as in the case of a lip seal.

Figure 3:
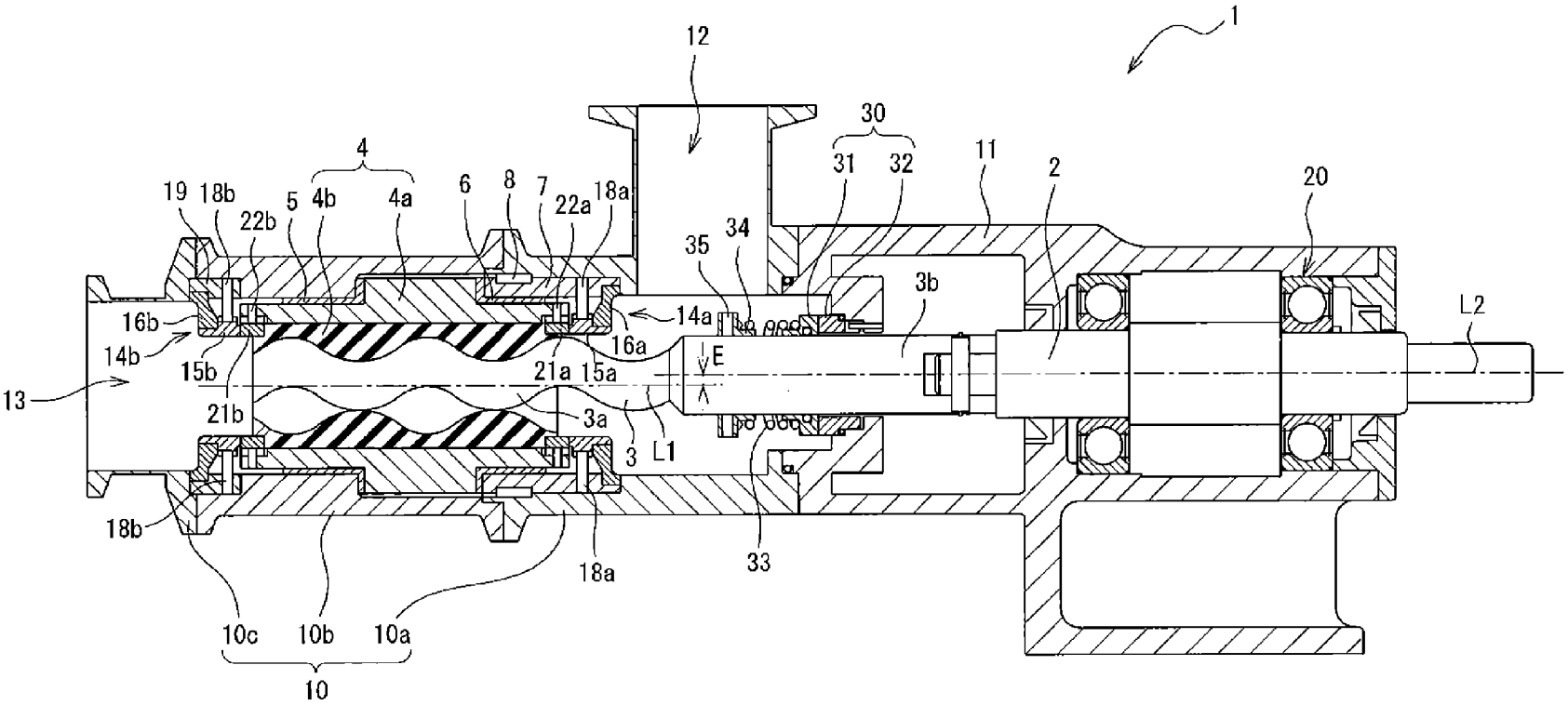
FIG. 3 is a side view of a stator seal structure in a uniaxial eccentric screw pump according to a third embodiment of the present invention, and illustrates substantial parts in a cross section taken along the axial line.

Next, a stator seal structure in a uniaxial eccentric screw pump according to a third embodiment of the present invention will be described with reference to FIG. 3. FIG. 3 is a side view of a stator seal structure in a uniaxial eccentric screw pump according to the third embodiment of the present invention. In FIG. 3, the substantial parts are illustrated in a cross section taken along the axial line. In FIG. 3, the same components and configurations as those illustrated in FIG. 1 and FIG. 2 have the same reference numerals and detailed explanations thereof will be omitted.

The uniaxial eccentric screw pump 1 illustrated in FIG. 3 has almost the same configurations with those illustrated in FIG. 2. In the sealing mechanisms 14*a* and 14*b*, however, the ways of attaching the rotating rings 21*a* and 21*b* to the outer stator cylinder 4*a* are different.

That is, the rotating ring 21*a* in the sealing mechanism 14*a* illustrated in FIG. 3 is same as the rotating ring 21*a* illustrated in FIG. 2 in that it is constituted by a ring-shaped member and is attached to an inner circumferential surface of the intake side end portion of the outer stator cylinder 4*a* in the stator 4. The rotating ring 21*a* illustrated in FIG. 2, however, is shrinkage fit on the inner circumferential surface of the intake side end portion, whereas the rotating ring 21*a* illustrated in FIG. 3 is secured to the inner circumferential surface of the intake side end portion by a pair of baffle pins 22*a*.

In addition, the rotating ring 21*b* in the sealing mechanism 14*b* illustrated in FIG. 3 is same as the rotating ring 21*b* illustrated in FIG. 2 in that it is constituted by a ring-shaped member and is attached to an inner circumferential surface of the discharge side end portion of the outer stator cylinder 4*a* of the stator 4. The rotating ring 21*b* illustrated in FIG. 2, however, is shrinkage fit on the inner circumferential surface of the discharge side end portion, whereas the rotating ring 21*b* illustrated in FIG. 3 is secured to the inner circumferential surface of the discharge side end portion by a pair of baffle pins 22*b*.

According to the stator seal structure in the uniaxial eccentric screw pump 1 illustrated in FIG. 3, it is possible to seal the housing 10 and the intake side end portion and the discharge side end portion of the stator 4 with certainty, in the same manner as the sealing mechanisms 14*a* and 14*b* illustrated in FIG. 2. Furthermore, the sealing portion can be constituted by sliding members superior in abrasion resistance in the same manner as the sealing mechanisms 14*a* and 14*b* illustrated in FIG. 2. It is therefore possible to improve the abrasion resistance of the pair of the sealing mechanisms 14*a* and 14*b* between the housing 10 and the intake side end portion of the stator 4 and between the housing 10 and the discharge side end portion of the stator 4. Hence, even if the pumped fluid has high abrasiveness, the problem of abrasion occurring in the short term can be avoided and a stable sealing property in the long term can be ensured.

Moreover, since the sealing portion is constituted by the secured rings 15*a* and 15*b* and the rotating rings 21*a* and 21*b* attached to the stator 4 constituting the rotating body, it is possible to solve the problem that the pumped fluid stagnates in the depressed area as in the case of a lip seal.

Figure 4:
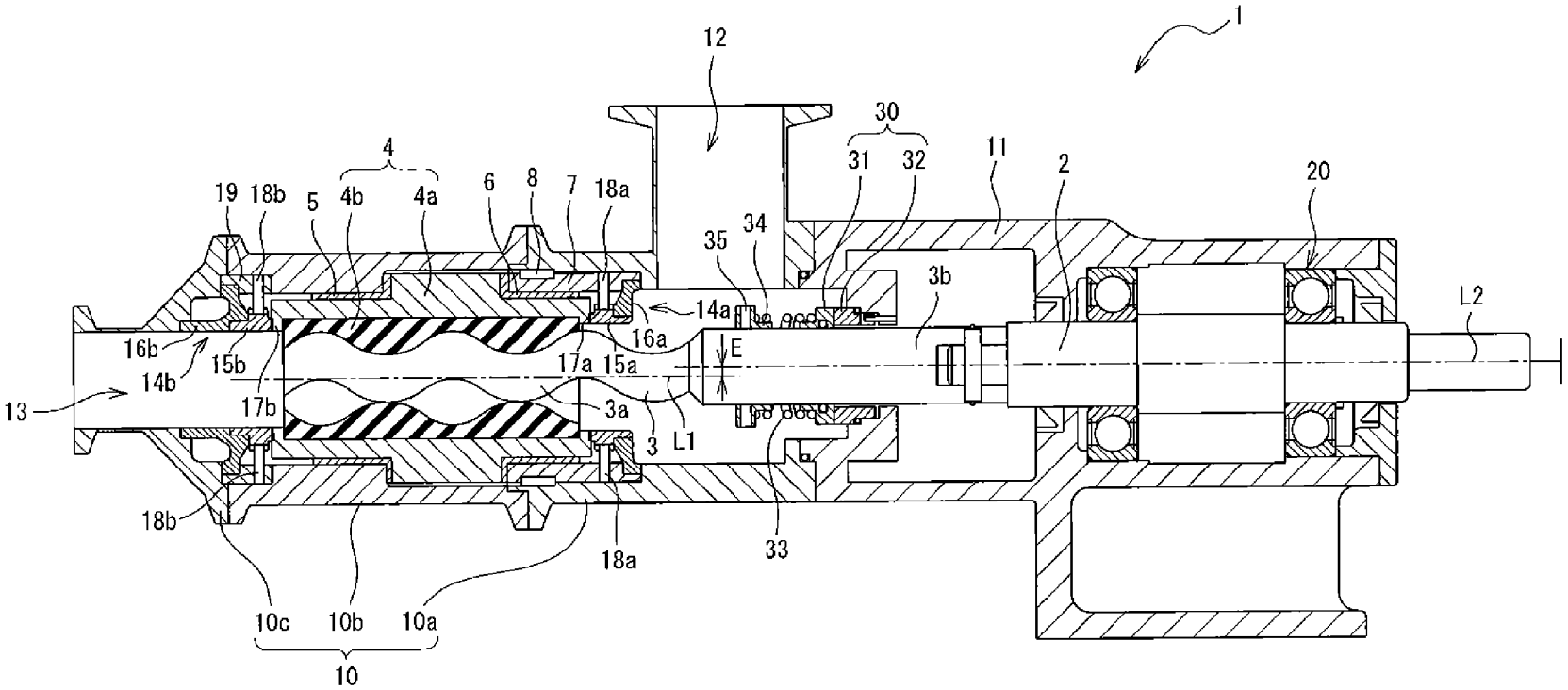
FIG. 4 is a side view of a stator seal structure in a uniaxial eccentric screw pump according to a fourth embodiment of the present invention, and illustrates substantial parts in a cross section taken along the axial line.

Next, a stator seal structure in a uniaxial eccentric screw pump according to a fourth embodiment of the present invention will be described with reference to FIG. 4. FIG. 4 is a side view of a stator seal structure in a uniaxial eccentric screw pump according to the third embodiment of the present invention. In FIG. 4, the substantial parts are illustrated in a cross section taken along the axial line. In FIG. 4, the same components and configurations as those illustrated in FIG. 1 have the same reference numerals and detailed explanations thereof will be omitted.

The uniaxial eccentric screw pump 1 illustrated in FIG. 4 has almost the same configurations with those illustrated in FIG. 1. The configuration of the sealing mechanism 14*b* at the discharge side end portion, however, is different.

That is, in the sealing mechanism 14*b* illustrated in FIG. 4, the inner diameter of the discharge side end portion of the outer stator cylinder 4*a* of the stator 4, the inner diameter of the secured ring 15*b* of the sealing mechanism 14*b* for sealing space between the housing 10 and the discharge side end portion of the stator 4, the inner diameter of the elastic body 16*b* attached to the secured ring 15*b*, and the inner diameter of the discharge portion 10*c* of the housing 10 have an identical diameter. The receiving surface has a cylindrical shape.

According to the stator seal mechanism of the uniaxial eccentric screw pump 1 illustrated in FIG. 4, since the inner diameter of the discharge side end portion of the outer stator cylinder 4*a* of the stator 4, the inner diameter of the secured ring 15*b* of the sealing mechanism 14*b* for sealing space between the housing 10 and the discharge side end portion of the stator 4, the inner diameter of the elastic body 16*b* attached to the secured ring 15*b*, and the inner diameter of the discharge portion 10*c* of the housing 10 have an identical diameter and the receiving surface has a cylindrical shape, the pressure of the fluid applied from the discharge portion 10*c* side of the housing 10 is prevented from being applied onto the secured ring 15*b* as a thrust load. This eliminates a dead space at the discharge portion and creates a smooth flow of the fluid.

Figure 5:
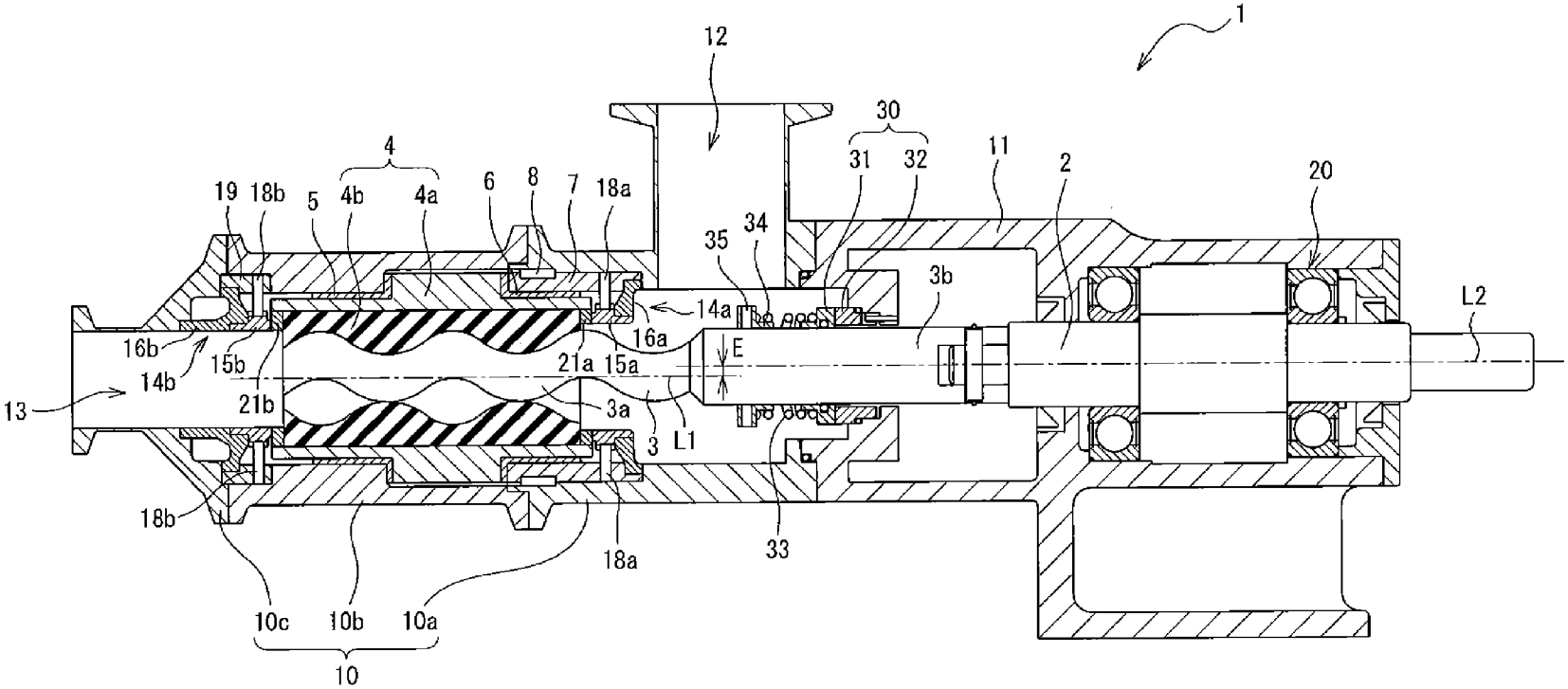
FIG. 5 is a side view of a stator seal structure in a uniaxial eccentric screw pump according to a fifth embodiment of the present invention, and illustrates substantial parts in a cross section taken along the axial line.
Figure 6:
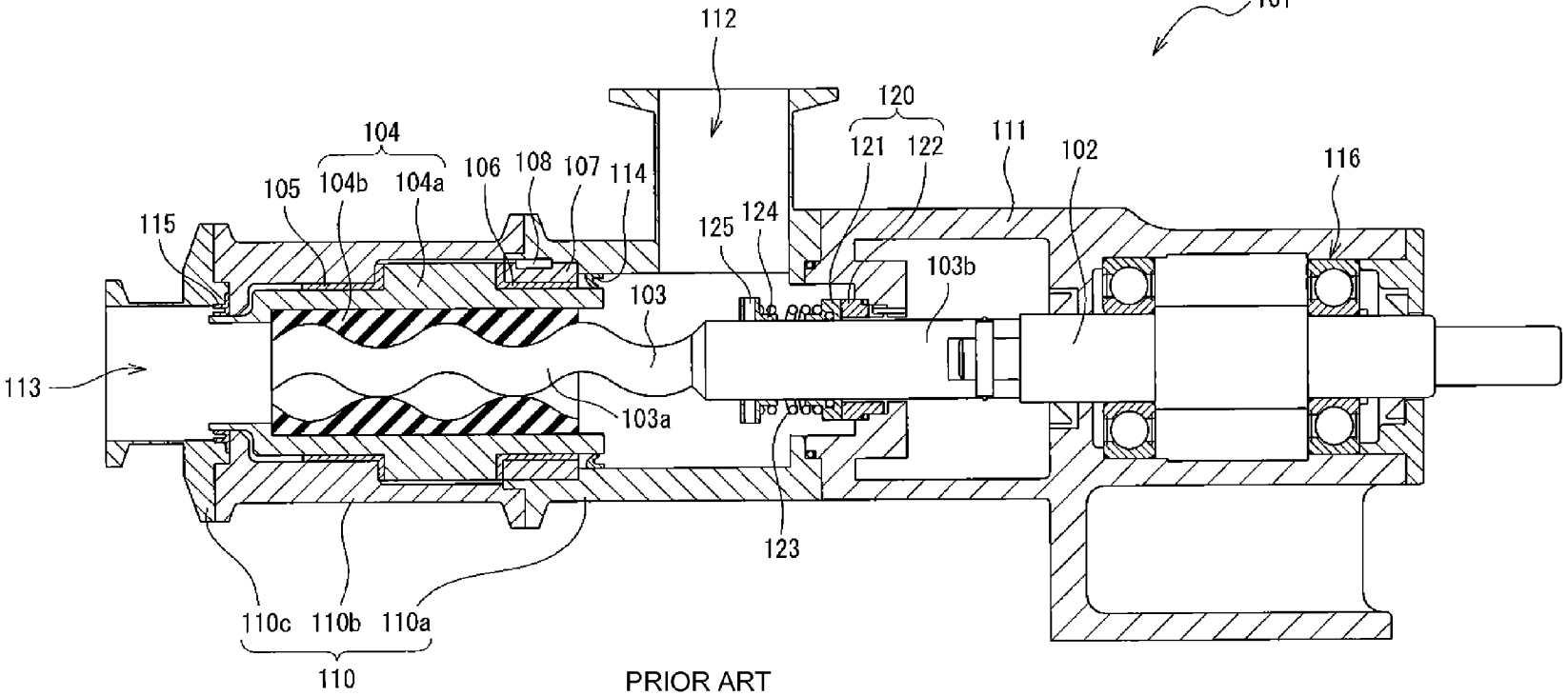
FIG. 6 is a side view of an example showing a conventional uniaxial eccentric screw pump in which a seal member is provided between a housing and an intake side end portion of a stator, and between the housing and a discharge side end portion of the stator, and illustrates substantial parts in a cross section taken along the axial line.

Next, a stator seal structure in a uniaxial eccentric screw pump according to a fifth embodiment of the present invention will be described with reference to FIG. 5. FIG. 5 is a side view of a stator seal structure in a uniaxial eccentric screw pump according to the fifth embodiment of the present invention. In FIG. 5, the substantial parts are illustrated in a cross section taken along the axial line. In FIG. 5, the same components and configurations as those illustrated in FIG. 2 and FIG. 4 have the same reference numerals and detailed explanations thereof will be omitted.

The uniaxial eccentric screw pump 1 illustrated in FIG. 5 has almost the same configurations as those illustrated in FIG. 2. The configuration of the sealing mechanism 14*b* at the discharge side end portion, however, is different.

That is, the sealing mechanism 14*b* illustrated in FIG. 5 has the same configuration as that of the sealing mechanism 14*b* illustrated in FIG. 4.

Therefore, according to the stator seal structure in the uniaxial eccentric screw pump 1 illustrated in FIG. 5, in the same manner as the stator seal structure illustrated in FIG. 4, the dead space is eliminated at the discharge portion so that a smooth flow of the fluid can be created. Specifically, the configuration of the sealing mechanism 14*b* illustrated in FIG. 4 and FIG. 5 is applicable to the stator seal structure in the uniaxial eccentric screw pump 1 illustrated in FIG. 3.

Heretofore, embodiments of the present invention have been described. The present invention, however, is not limited to those embodiments, and modifications and adaptations to those embodiments may occur.

For example, in the uniaxial eccentric screw pump 1 illustrated in FIG. 1 to FIG. 5, the secured rings 15*a* and 15*b* may be secured to the housing 10 directly.

In addition, in the uniaxial eccentric screw pump 1 illustrated in FIG. 2 and FIG. 3, the rotating rings 21*a* and 21*b* may have any configuration as long as they are attached to the outer stator cylinder 4*a*. The present invention is not limited to the case where the rotating rings 21*a* and 21*b* are attached to the outer stator cylinder 4*a* by shrinkage fitting or the case where the rotating rings 21*a* and 21*b* are attached to the outer stator cylinder 4*a* by the rotating rings 22*a* and 22*b*, respectively.

The invention claimed is:

1. A stator seal structure in a uniaxial eccentric screw pump, the stator seal structure comprising:

a male-threaded rotor coupled to a driving shaft;

a stator rotatably coupled to a housing via a bearing and having a female-threaded inner surface with a rotational axial line arranged to be eccentric with respect to a rotational axial line of the rotor; and a pair of sealing mechanisms for sealing space between the housing and an intake side end portion of the stator, and between the housing and a discharge side end portion of the stator, wherein each of the pair of sealing mechanisms has a ring-shaped secured ring arranged opposite to the stator in a direction of the rotational axial line of the rotor and secured to the housing, the ring-shaped secured ring having a sliding seal surface sliding on a sliding seal surface of the stator, wherein the ring-shaped secured ring is attached with an elastic body for ensuring with an elastic force of the elastic body a contact pressure between the sliding seal surface of the stator and the sliding seal surface of the ring-shaped secured ring and for sealing space between the secured ring and the housing, wherein the ring-shaped secured ring is made of ceramics or cemented carbide, and wherein the sliding seal surface of the stator is coated with ceramics.

2. A stator seal structure in a uniaxial eccentric screw pump, the stator seal structure comprising:

a male-threaded rotor coupled to a driving shaft;

a stator rotatably coupled to a housing via a bearing and having a female-threaded inner surface with a rotational axial line arranged to be eccentric with respect to a rotational axial line of the rotor; and a pair of sealing mechanisms for sealing space between the housing and an intake side end portion of the stator, and between the housing and a discharge side end portion of the stator, wherein each of the pair of sealing mechanisms has a ring-shaped rotating ring attached to the stator, and has a secured ring arranged opposite to the ring-shaped rotating ring in a direction of the rotational axial line of the rotor and secured to the housing, the secured ring having a sliding seal surface sliding on a sliding seal surface of the ring-shaped rotating ring, wherein the secured ring is attached with an elastic body for ensuring with an elastic force of the elastic body a contact pressure between the sliding seal surface of the rotating ring and the sliding seal surface of the secured ring and for sealing between the secured ring and the housing, wherein the ring-shaped rotating ring is made of ceramics or cemented carbide, and wherein the secured ring is made of ceramics or cemented carbide.

3. The stator seal structure in the uniaxial eccentric screw pump according to claim 2, wherein the ring-shaped rotating ring is shrinkage fit to the stator.

4. The stator seal structure in the uniaxial eccentric screw pump according to claim 2, wherein the ring-shaped rotating ring is secured to the stator by a baffle pin.

5. The stator seal structure in the uniaxial eccentric screw pump according claim 1, wherein inner diameters of the discharge side end portion of the stator, the ring-shaped secured ring of the sealing mechanism for sealing between the housing and a discharge side end portion of the stator, the elastic body attached to the ring-shaped secured ring, and a discharge portion of the housing have the same size, and a pressure-receiving surface has a cylindrical shape.

* * * * *